United States Patent [19]

Funk

[11] Patent Number: 4,986,881

[45] Date of Patent: Jan. 22, 1991

[54] METHOD AND APPARATUS FOR LIQUID TREATMENT OF AND LIQUID EXTRACTION ON A PAPER PULP

[75] Inventor: Erwin D. Funk, Queensbury, N.Y.

[73] Assignee: Kamyr, Inc., Glens Falls, N.Y.

[21] Appl. No.: 372,447

[22] Filed: Jun. 28, 1989

[51] Int. Cl.[5] ..... D21C 9/02; D21C 9/06

[52] U.S. Cl. ..... 162/56; 162/60; 68/158; 68/181 R; 8/156; 210/386; 210/402; 210/772

[58] Field of Search ..... 68/181 R, 182, 156, 68/158; 8/156; 162/60, 56, 59, 261; 210/386, 402, 772, 404

[56] References Cited

U.S. PATENT DOCUMENTS

| | | | |
|---|---|---|---|
| 3,980,518 | 9/1976 | Ljung et al. | 162/302 |
| 4,266,413 | 5/1981 | Yli-Vakkuri | 68/181 R |
| 4,491,501 | 1/1985 | Klein | 8/156 |
| 4,534,868 | 8/1985 | Barbulescu et al. | 210/780 |
| 4,769,986 | 9/1988 | Kokkonen et al. | 162/60 |

OTHER PUBLICATIONS

Pettersson et al, "New Systems for Improved Brown Stock Washing", 1986 Engineering Conference, pp. 603-609.

Kamyr, Inc. "Ring" ® Press Information Guide, Bulletin No. KGD1804-MEO189.

Kamyr, Inc. "Wash Press" brochure.

*Primary Examiner*—David L. Lacey
*Assistant Examiner*—Todd J. Burns
*Attorney, Agent, or Firm*—Nixon & Vanderhye

[57] ABSTRACT

It is desirable to be able to treat medium consistency (e.g. about 8-12% by weight) paper pulp suspensions with treatment liquid (e.g. a wash liquid), and to thicken the pulp to about 30-50% consistency at the same time. A moving (e.g. rotating) channel is defined by a root wall and upstanding side walls—some or all of which are perforated—and treatment liquid is introduced by an arcuately elongated distributor with perforated side walls into the center of the pulp within the channel, filtrate flowing out through the perforated walls. A pivoted wall portion of the stationary housing of the treatment device restricts outflow of the thickened pulp cake from the device, the cake flowing between a doctor blade and the pivoted wall portion.

20 Claims, 3 Drawing Sheets

METHOD AND APPARATUS FOR LIQUID TREATMENT OF AND LIQUID EXTRACTION ON A PAPER PULP

BACKGROUND AND SUMMARY OF THE INVENTION

During the production of paper from cellulosic fibrous material pulp, it is typically necessary to add specific chemicals to the pulp for performing various operations, or to wash out the chemicals from the pulp. The addition of chemicals may be effected by displacement flow through the pulp mass, and washing is typically performed by one or more sequences of displacement of wash liquid through the pulp mass followed by pressing of the wash liquid from the mass.

Conventional wash presses typically require dilute pulp supplied in the consistency range of about 2 to 5%. The dilution allows the pulp to spread evenly onto the wash press filter media to form a web or mat. The filter media is conventionally a perforated rotating drum or moving belt. The pulp is thickened on the filter media to about 10–16% consistency usually by application of pressure to the mat or by vacuum draw. After thickening, washing of the chemicals from the pulp mat is accomplished by forcing wash water through the mat (displacement) using hydraulic pressure or drawing wash water through with a vacuum. Finally, the mat is compressed by the wash press to high consistency of 30 to 50% to achieve a high total washing efficiency. The conventional method of compressing the mat for pressing is to pass it through the nip of rollers or press on it with a belt moving the same speed as the mat.

According to the present invention, many difficulties and inconveniences associated with the prior art wash presses may be eliminated while still providing effective treatment of the pulp. The invention can be used not only for washing of the pulp with a final step of pressing, but also for chemical treatment of the pulp. The invention effects the desired results in a simple manner and with a minimum of moving parts. According to the invention it is possible to supply pulp at a consistency range of about 2–16%, and preferably about 8 to 12% (that is medium consistency pulp) which eliminates the need for thickening at the inlet, which in turn minimizes screen (filter) area. The device according to the invention can compress the pulp without the need of a nip, roll, or moving belt, and can eliminate the need to back wash the filter media for cleaning due to fibers stuck in the filter media. In conventional wash presses the mat moves at the same speed as the press roller belt so that the fibers are pressed firmly against the filter media and some fibers staple into the perforations of the filter media. According to the invention, however, during pressing, compressed pulp drags fibers from screen perforations, producing a self-cleaning effect.

According to one aspect of the present invention, a device is provided for liquid treatment of a suspension of cellulosic fibrous material (paper pulp) comprising the following elements: (a) A housing having an outer, essentially solid, wall; including a restricting adjustable portion. (b) Means defining a channel having a root wall and a pair of side walls with an open face opposite the root wall, the channel being positioned so that the open face thereof is adjacent the housing outer wall, and at least one of the walls is perforated. (c) Means for moving the root wall, and at least one of the side walls, with respect to the outer wall in the dimension of elongation of the channel. (d) Means for feeding material to be treated into the channel at one portion of the housing. (e) An outlet for passage of treated material out of the channel and the housing adjacent the restricting adjustable portion of the housing outer wall. (f) Means for introducing treatment fluid into the channel, between the means (d) and (e), through the housing outer wall, so that the treatment fluid passes through the material to treat it, and out perforations in at least one of the channel walls. And, (g) means for providing discharge of liquid from the housing that has passed through perforations in at least one of the channel walls.

The device according to the present invention operates on the same basic principle as the press illustrated and described in U.S. Pat. No. 4,534,868 (the disclosure of which is hereby incorporated by reference herein), as evidenced by the commercial product sold by Kamyr, Inc. of Glens Falls, N.Y. under the trademark "Ring" ®. During pressing, the channel perforated walls move faster than the compressed pulp and consequently the fibers do not staple into the perforations. Instead the compressed pulp drags fibers from the perforations producing a self-cleaning effect.

The means for introducing treatment liquid into the channel comprises a hollow distributor extending from the outer wall into the approximate center of the channel between the side walls, and comprises a pair of perforated side walls. The side walls are parallel to the channel side walls, both of which are preferably perforated while the root wall is not. The end wall of the distributor is closely spaced from the root wall and also is perforated. The housing outer wall is preferably arcuate, and the root wall is an arcuate wall of a rotor with the side walls extending radially outwardly therefrom, and a plurality of the distributors are provided along the housing outer wall circumferentially spaced from each other in the direction of movement of the channel.

The invention also relates to a method for treating a pulp suspension using an arcuate root wall rotatable about an axis and defining an open channel with a pair of side walls extending radially outwardly with respect to the root wall. At least one of the side walls is rotatable with the root wall and at least one of the channel defining walls is perforated. The method comprises the steps of continuously and progressively: (a) Rotating the root wall about an axis. (b) Introducing a suspension of cellulosic fibrous material at a consistency of about 2–16% by weight (preferably about 8–12%) into the channel. (c) Introducing treatment fluid into the suspension in a center portion of the channel so that the treatment fluid permeates the suspension. (d) Effecting removal of liquid from the channel through the perforated walls defining the channel to facilitate treatment and thickening of the suspension. And, (e) discharging suspension having a consistency greater than that of the introduced suspension (e.g. about 30–50%). Step (c) is preferably practiced by introducing treatment liquid in distributors extending into the channel from the open part thereof opposite the root wall so that the treatment liquid flows substantially uniformly into the suspension at all portions along the radial extent thereof. The treatment liquid preferably comprises a wash liquid, but may also be any of a wide variety of treatment chemicals depending upon the particular end use of the pulp.

It is the primary object of the present invention to provide for the simple yet effective chemical treatment and/or washing of pulp. This and other objects of the invention will become clear from an inspection of the detailed description of the invention and from the appended claims.

DETAILED DESCRIPTION OF THE DRAWINGS

Figure 1:
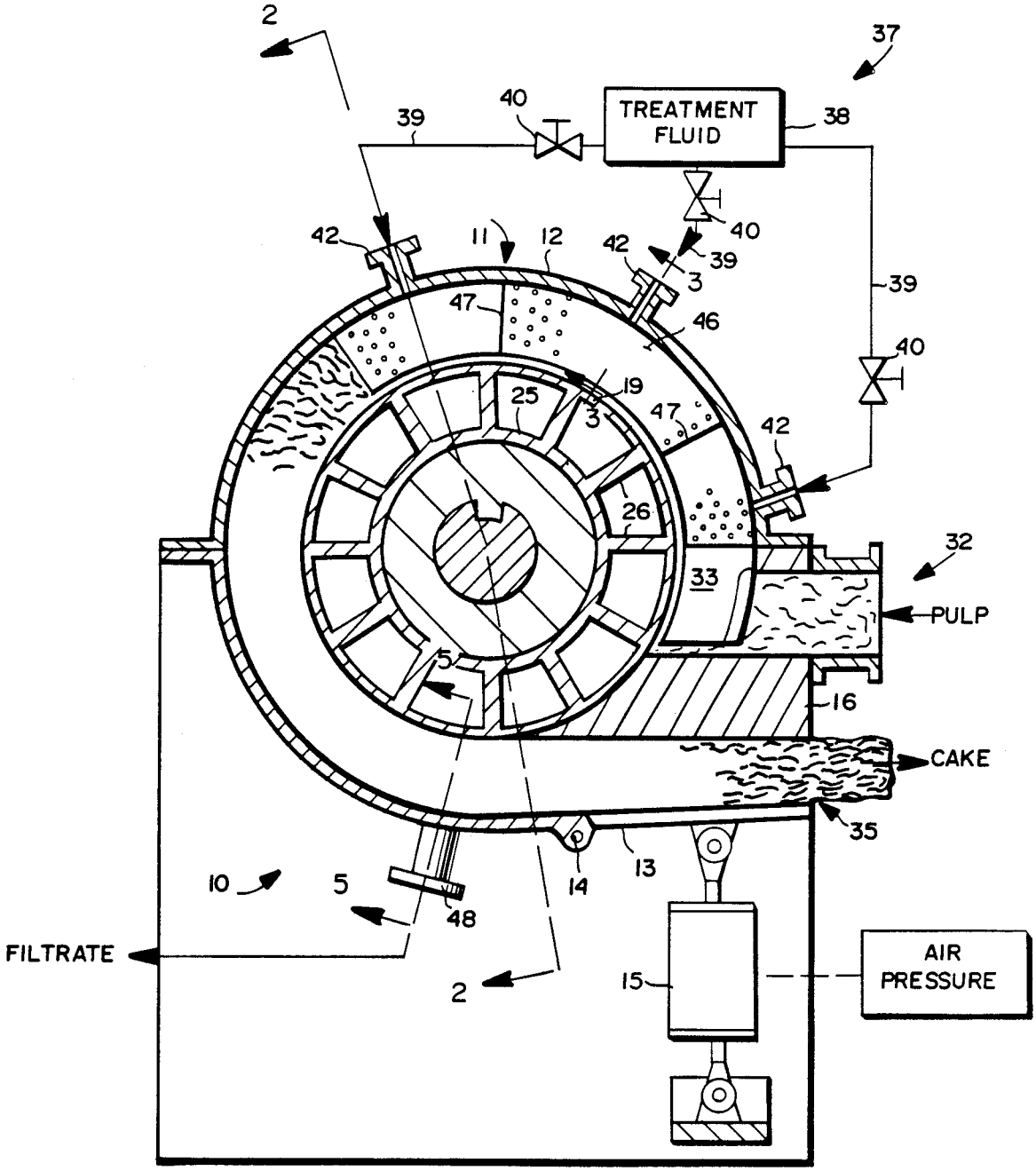
FIG. 1 is a end diagrammatic view partly in cross-section and partly in elevation of an exemplary device according to the invention.
Figure 2:
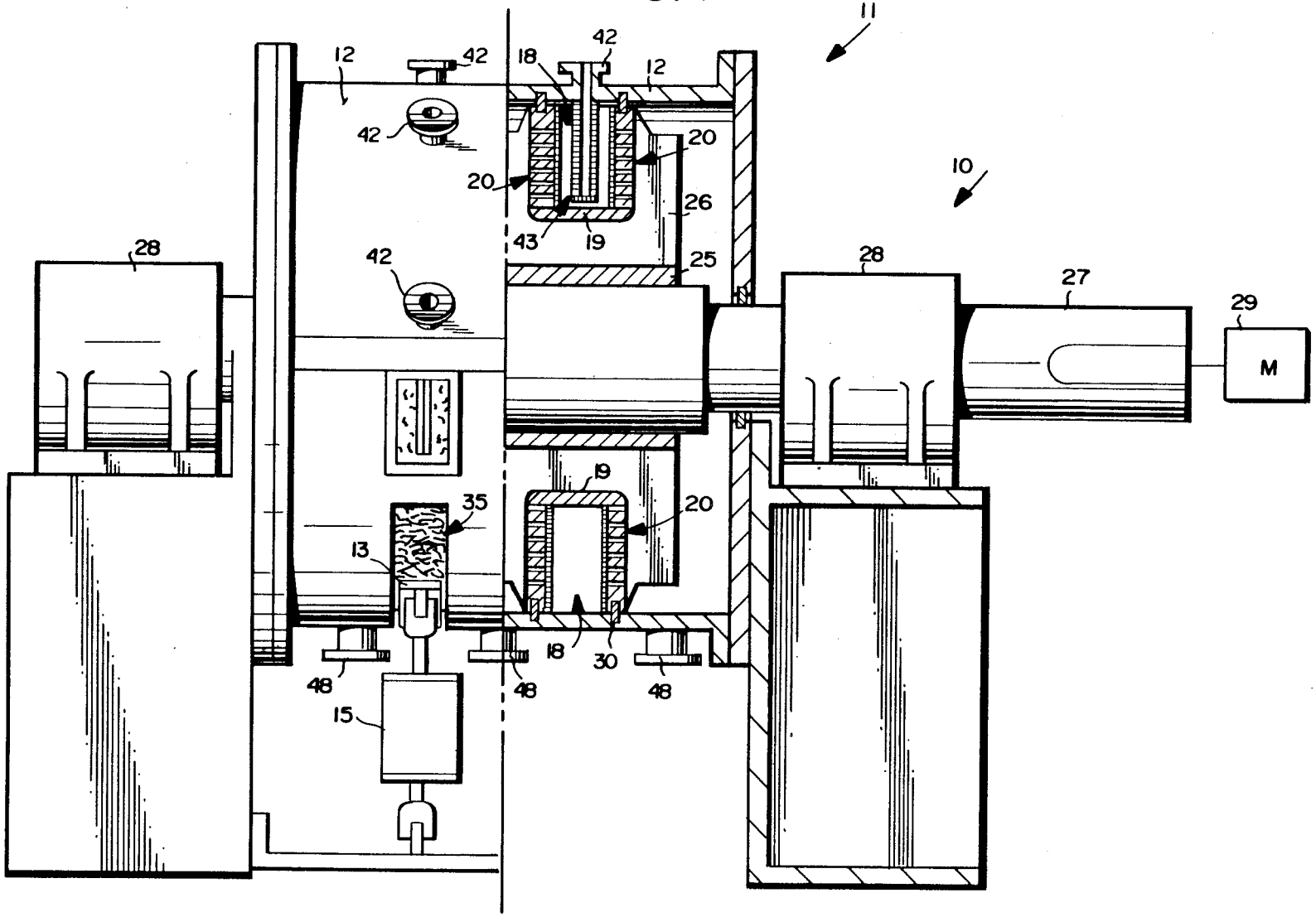
FIG. 2 is a side view of the device of FIG. 1 with portions thereof shown in cross-section but the majority shown in elevation.

A device for the liquid treatment of a suspension of cellulosic fibrous material is illustrated generally by reference numeral 10 in FIGS. 1 and 2. The device includes a housing 11, with an outer essentially solid wall 12, and a restricting adjustable portion 13. The portion 13 is pivoted about point 14 and is operated by a pneumatic cylinder 15. The adjustable portion 13 restricts the pulp at the discharge portion of the housing between it and a doctor blade 16.

Figure 3:
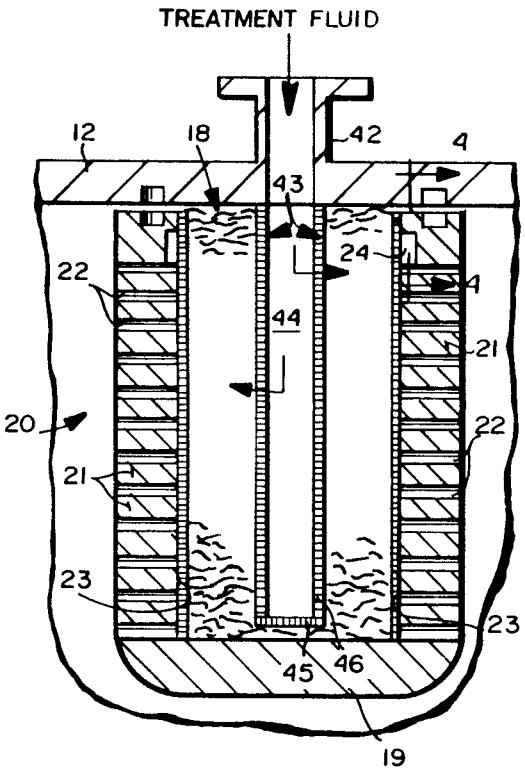
FIG. 3 is a cross-sectional detail view of the channel with treatment fluid introduction means of the device of FIGS. 1 and 2, the section taken along lines 3—3 of FIG. 1.
Figure 4:
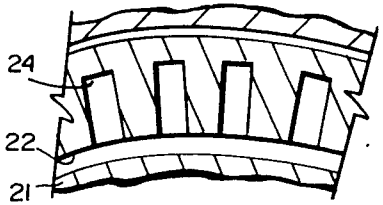
FIG. 4 is a detail view of a portion of the channel defining elements of FIG. 3 taken along lines 4—4 thereof.

The device 10 also comprises means for defining a channel 18 having a root wall 19 and a pair of side walls 20, with an open face opposite the root wall 19, as clearly seen in FIGS. 2 and 3. The channel 18 is positioned so that the open face thereof is adjacent the housing outer wall. At least one of the walls 19, 20 is perforated. Preferably both of the side walls 21 are rigid plates with openings 22 (e.g. circular holes or slots) formed therein, and on the interior portion of the wall 20 a liner screen 23 with small conical holes for good filtration is provided. The root wall 19 preferably is not perforated. Note the radial grooves 24 provided in the side walls 20, too, as illustrated in FIG. 4.

The device 10 also comprises means for moving the root wall 19, and at least one of the side walls 20 (and preferably—as illustrated in the drawings —both of the side walls 20) with respect to the outer wall 12 in the dimension of elongation of the channel 18. While the device 10 may be constructed as a linear device (e.g. see FIGS. 1 and 3 of U.S. Pat. No. 4,534,868), preferably it is a rotary device, and to this end the means for moving the root wall 19 comprises a rotor including an inner tubular portion 25 having radially extending ribs 26 (see FIGS. 1 and 2) emanating outwardly therefrom, the ribs 26 being connected to the root wall 19 and through it to the side walls 20. The inner tube 25 is keyed to a shaft 27 mounted by bearings 28 for rotation about a generally horizontal axis, powered by the motor 29. The motor 29 will rotate the shaft 27, tube 25, with its associated root wall, etc., counter-clockwise as viewed in FIG. 1.

Figure 5:
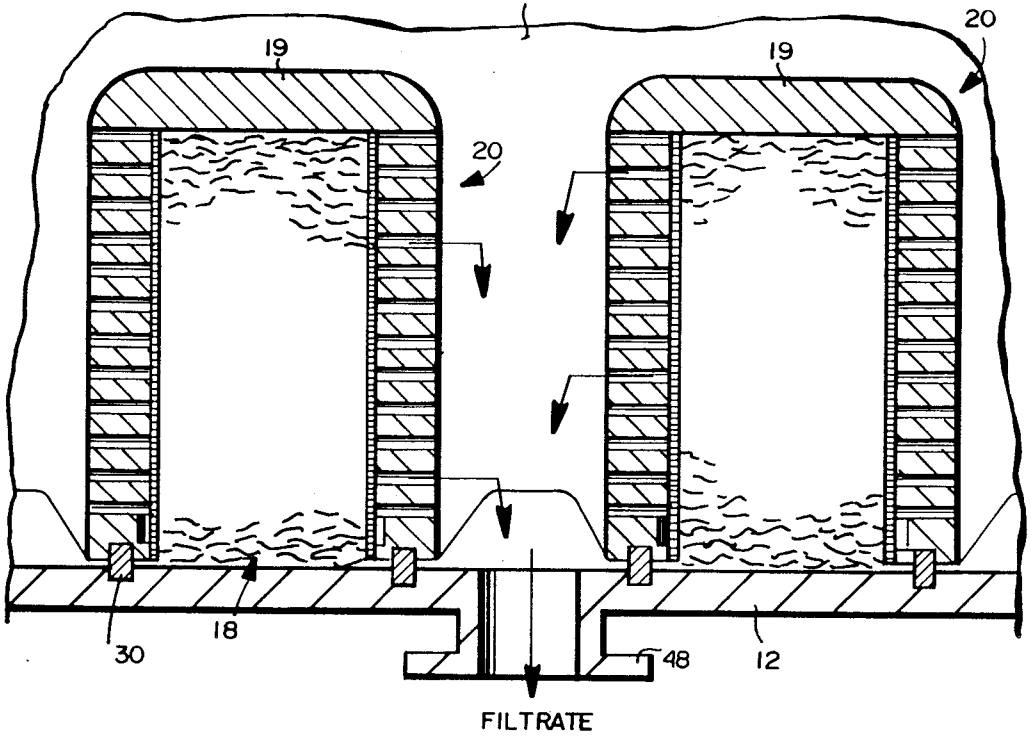
FIG. 5 is a cross-sectional detail view of two channels in the extraction arc portion of the device of FIGS. 1 and 2.

A plurality of channels 18 can be supported by the rotor 25, 26; for example FIGS. 2 and 5 illustrate an embodiment in which two channels 18 are supported the rotor 25, 26. Note that conventional seals (e.g. bridging elastomeric or metal sealing material) 30 (see FIGS. 2 and 5 in particular) may be provided between the housing wall 12 and each of the side plates 20, but preferably open grooves (see FIG. 3) are provided which are filled with pulp fibers which form a seal.

The device 10 also comprises means for feeding pulp to be treated into the channel 18 at one portion of the housing 11. Such means—in the exemplary embodiment illustrated—includes the inlet connector 32, which is defined in part by the doctor 16, and the splitter segment 33. The splitter 33 may have a knife like edge facing the inlet 32 to reduce turbulence and to aid in equal division of the incoming pulp on either side thereof into the channel 18. An inlet 32 is provided for each channel 18.

The device 10 also comprises an outlet 35 (see FIG. 1) for passage of treated pulp out of the channel 18 and the housing 11 adjacent the restricting adjustable portion 13 of the outer wall 12. The outlet 35 is defined at the top and bottom thereof by the adjustable portion 13 and the doctor blade 16. The doctor blade 16 has approximately the same width as the interior of the channel.

What has heretofore been described (except for the splitter segment 33) is present in a commercial press sold by Kamyr, Inc. of Glens Falls, N.Y. under the trademark "Ring" ®. According to the present invention, however—unlike in the Ring ® press—it is possible to treat pulp with treatment fluid within the device 10, and to this end means for introducing treatment fluid into the channel 18, between the inlet 32 and the outlet 35, are provided. This means for introducing treatment fluid may introduce treatment chemicals, but preferably introduces wash liquid which will be displaced through the pulp.

The means for introducing treatment fluid is illustrated generally by reference numeral 37 in FIG. 1, and includes the source or sources of treatment fluid 38, connected by conduits 39 with valves 40 therein to inlet nozzles 42. The nozzles 42 introduce the treatment fluid through the outer wall 12 of the housing 11 at variously positioned arcuate spacings therealong. For example as illustrated in FIG. 1, three inlet nozzles 42 are provided the first disposed immediately adjacent the inlet 32, and the others spaced about 30°-60° along the circumference of the housing 12. The area in which the nozzles 42 are disposed is referred to as the "treatment arc" of the device 10.

The treatment fluid introducing means 37 portions within the housing 11 are illustrated more clearly in FIGS. 2 and 3, and include a hollow distributor 43, having a hollow interior 44, extending from the wall 12 into the approximate center of the channel 18 between the side walls 20 of the channel 18. The distributor 43 preferably includes a perforated (screened) bottom wall 45 which is adjacent, but spaced from, the root wall 19, and perforated or screened side walls 46, so that the treatment fluid is uniformly introduced into the pulp mass within the channel 18, as illustrated by the arrows in FIG. 3. To allow the introduction of different types of treatment fluid at various portions along the direction of elongation of the channel 18, solid radially extending dividing walls 47 (see FIGS. 1 and 3) may be provided to divide the area between the side walls 46 into three different compartments, one associated with each nozzle 42. Any number of components may be provided. The distributor 43 typically has an arcuate extent of about 80°-180° (e.g. about 120°).

Finally, the device 10 includes means for providing discharge of liquid that has been pressed from the pulp from the housing 11—i.e. liquid that has passed through the side walls 20 of the channel 18. The liquid discharge means preferably comprises a plurality of filtrate outlets 48, seen in FIGS. 1, 2, and 5. The withdrawn filtrate moves in a circumferential flow path past the ribs 26, and through the closest outlet 48.

OPERATION

In operation of the device 10, pulp is pumped or conveyed by a screw or the like at a consistency range of about 2–16% by weight, and preferably about 8–12% (i.e. medium consistency) into the inlet connector 32. In the embodiment illustrated in the drawings, two inlet connectors 32 will be provided, one for each channel 18. The pulp is split into two flow paths by the splitter segment 33, one section of pulp flowing on each side of the distributor 43 (see FIG. 3).

As the rotor 25, 26 rotates, the root wall 19, and side walls 20, defining the channel 18, rotate counter-clockwise (FIG. 1), and the pulp rotates with the channel 18. The treatment liquid, such as wash liquid, is introduced from source 38 through conduits 39 into nozzles 42, to flow into the hollow interior of the distributor 43, and passes through the perforations in the side walls 46 and end wall 45 to uniformly treat the pulp. The pressure within the distributor 43 is higher than the pressure within the pulp in the channel 18, and the pressure in the pulp in channel 18 is higher than the pressure in the housing 11. The pressure in the housing 11 may be superatmospheric or sub-atmospheric, but preferably is atmospheric. Since a pressure drop occurs in the direction toward the channel side walls 20, the pulp will tend to be held against the channel side walls 20 and move with the rotating channel 18. Liquid that is displaced from the pulp exits the channel through the liner screens 23 and openings 22 in the side walls, and ultimately flows past the rotor ribs 26 and then circumferentially around the rotor 25, 26 to the filtrate outlets 48. A different treatment fluid may be associated with each nozzle 42, or the same treatment fluid can be introduced into each nozzle 42.

Chemical treatment or washing of the pulp occurs through a treatment arc of the housing 11, that is until a particular portion of the pulp being carried by the rotating channel 18 reaches the end of the distributor 43 (approximately 120° from the inlet 32 in the embodiment illustrated in FIG. 1). At that portion the pulp then enters what is referred to as the "extraction arc" of the device 10. In this arcuate portion, which extends from the end of the distributor 43 to the outlet 35, a void occurs immediately after the end of the distributor 43, and the channel 18 moves faster than the pulp. This speed differential occurs because the restriction formed by the movable wall 13 retards the movement of the pulp, and as a result the pulp is compacted and all the void spaces therein are closed up. The compaction is provided by the action of friction of the channel walls 20, 19 against the pulp, and the compaction becomes progressively greater from the distributor 43 to the outlet 35. The compaction causes the fibers of the pulp to be tightly compressed against each other leaving a minimum amount of space for liquid, and the liquid that is compressed out of the pulp moves through the channel side walls 20 to ultimately pass out the filtrate outlets 48.

The intensity of the compression is controlled by actuation of the pneumatic cylinder 15, which controls the position of the wall 13 with respect to the doctor blade 16. The pressure applied by the pneumatic cylinder 15 can be adjusted to provide outlet cake consistencies ranging from about 30–50% by weight, typically about 40%. According to the invention, during pressing, since the channel walls 20 move faster than the compressed pulp, the fibers do not staple into the perforations in the walls 20 and instead the compressed pulp drags the fibers from the perforations producing a self-cleaning affect. Ultimately, the pulp passes to the doctor blade 16. The doctor blade 16, in addition to forming one wall of each of the inlet 32 and outlet 35, serves to straighten the compressed pulp and cause it to peel away from the root wall 19, and the side walls 20. The discharged cake is then acted on further in any conventional manner desired.

It will thus be seen that according to the present invention a method and apparatus have been provided for the simple yet effective treatment of cellulosic fibrous material suspensions that overcomes many of the problems associated with prior art procedures and apparatus. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A device for liquid treatment of a suspension of cellulosic fibrous material, comprising:

(a) a housing having an outer, essentially solid, wall; including an adjustable portion; p1 (b) means defining a channel having a solid root wall and a pair of side walls with an open face opposite said root wall, the channel being elongated in a dimension and positioned so that the open face thereof is adjacent said housing outer wall, and at least one of said side walls is perforated;

(c) means for moving said root wall, and at least one of said side walls, with respect to said outer wall in the dimension of elongation of said channel;

(d) means for feeding material to be treated into said channel at one portion of said housing;

(e) an outlet for passage of treated material out of said channel and said housing adjacent said adjustable portion of said housing outer wall;

(f) means for introducing treatment fluid into said channel, between said means (d) and (e), through said housing outer wall, so that the treatment fluid passes generally parallel to said root wall, through the material to treat it, and out perforations in at least one of said channel walls; and (g) means for providing discharge from the housing of liquid that has passed through perforations in at least one of said channel walls.

2. A device as recited in claim 1 wherein said means (f) comprises a hollow distributor extending from the outer wall into the approximate center of said channel between said side walls, said distributor comprising a pair of perforated side walls, and having a significant length in the channel direction of elongation.

3. A device as recited in claim 2 wherein said means (f) side walls are parallel to said channel side walls, and wherein said channel side walls are perforated.

4. A device as recited in claim 3 wherein said channel side walls are perforated plates with linear screens disposed on the interiors thereof.

5. A device as recited in claim 4 wherein said distributor side walls comprise screens, and wherein said distributor has an end wall closely spaced from said root wall, said end wall also comprising a screen.

6. A device as recited in claim 5 further comprising a plurality of nozzles for feeding treatment fluid to said hollow distributor, said nozzles provided along said housing outer wall spaced from each other in the direction of movement of said channel.

7. A device as recited in claim 1 wherein said housing outer wall is arcuate, and wherein said root wall is an arcuate wall of a rotor, said side walls extending radially outwardly therefrom; and wherein said means (c) comprises means for rotating said root wall and rotor about a generally horizontal axis, and wherein said means (f) introduces fluid so that it flows parallel with respect to said axis through the material.

8. A device as recited in claim 7 wherein said rotor has mounted thereto a plurality of said root walls spaced from each other along the axis of rotation of said rotor, each of said root walls has a pair of associated said side walls, cooperating with said housing outer wall, and including said cooperating means (d), (f), (g) and outlet elements.

9. A device as recited in claim 8 wherein said rotor comprises an inner metal tube, a plurality of ribs extending radially outwardly from said inner tube, said arcuate root walls attached to said ribs and radially spaced from said inner tube; and further comprising a shaft keyed to said inner tube.

10. A device as recited in claim 1 wherein said channel side walls are perforated plates with liner screens disposed on the interiors thereof, and said root wall is solid.

11. A device as recited in claim 2 wherein said distributor has an arcuate length of about 80°-180°.

12. A device as recited in claim 11 further comprising a plurality of nozzles for feeding treatment fluid to said hollow distributor, said nozzles provided along said housing outer wall spaced from each other in the direction of movement of said channel.

13. A device as recited in claim 2 wherein said distributor side walls comprise screens, and wherein said distributor has an end wall closely spaced from said root wall, said end wall also comprising a screen.

14. A device as recited in claim 2 further comprising a plurality of nozzles for feeding treatment fluid to said hollow distributor, said nozzles provided along said housing outer wall spaced from each other in the direction of movement of said channel.

15. A device as recited in claim 2 wherein said housing outer wall is arcuate, and wherein said root wall is an arcuate wall of a rotor, said side walls extending radially outwardly therefrom; and wherein said means (c) comprises means for rotating said root wall and rotor about a generally horizontal axis, and wherein said distributor introduces fluid so that it flows parallel with respect to said axis through the material.

16. A device as recited in claim 1 wherein said means (e) includes said adjustable portion of said housing outer wall, and a doctor blade disposed on the opposite side of said channel from the adjustable portion.

17. A method for treating a suspension of cellulosic fibrous material, using an arcuate root wall rotatable about an axis and defining an open channel with a pair of side walls extending radially outwardly with respect to the root wall, at least one of the side walls rotatable with the root wall, and at least one of the channel-defining walls being perforated, said method comprising continuously and progressively:

(a) rotating the root wall about an axis;

(b) introducing a suspension of cellulosic fibrous material at a consistency of about 2-16% by weight into the channel;

(c) introducing treatment fluid into the suspension in a center portion of the channel so that the treatment fluid permeates the suspension, flowing parallel with respect to said axis therethrough;

(d) effecting removal of liquid from the channel through perforated walls defining the channel to facilitate treatment and thickening of the suspension; and (e) discharging suspension having a consistency greater than that of the introduced suspension.

18. A method as recited in claim 17 wherein step (a) is practiced by introducing a suspension having a consistency of about 8-12% into the channel.

19. A method as recited in claim 18 wherein steps (d) and (e) comprise pressing the suspension and discharging a suspension having a consistency of about 30-50%.

20. A method as recited in claim 17 wherein step (c) comprises introducing treatment liquid in a distributor extending into the channel from the open part thereof opposite the root wall so that the treatment liquid flows substantially uniformly into the suspension at all portions along an arcuate extent thereof of about 80°-180°.

* * * * *